US008526643B2

(12) United States Patent
Lin et al.

(10) Patent No.: US 8,526,643 B2
(45) Date of Patent: Sep. 3, 2013

(54) SPEAKER

(75) Inventors: Chung-Hong Lin, Taipei (TW); Shao-Tsu Kung, Taipei (TW)

(73) Assignee: Compal Electronics, Inc., Taipei City (TW)

( * ) Notice: Subject to any disclaimer, the term of this patent is extended or adjusted under 35 U.S.C. 154(b) by 126 days.

(21) Appl. No.: 13/294,189

(22) Filed: Nov. 11, 2011

(65) Prior Publication Data

US 2012/0121112 A1 May 17, 2012

Related U.S. Application Data

(60) Provisional application No. 61/412,397, filed on Nov. 11, 2010.

(51) Int. Cl.
*H04R 25/00* (2006.01)

(52) U.S. Cl.
USPC ..... 381/191; 381/150

(58) Field of Classification Search
USPC ..... 381/191, 186, 150
See application file for complete search history.

(56) References Cited

FOREIGN PATENT DOCUMENTS

TW 201008302 2/2010

*Primary Examiner* — Brian Ensey
*Assistant Examiner* — Norman Yu
(74) *Attorney, Agent, or Firm* — Jianq Chyun IP Office

(57) ABSTRACT

A speaker includes a base, a diaphragm, a separating module, a first electrode set and a second electrode set. The base and a porous structure are formed a cavity. The diaphragm is disposed in the cavity and includes a first part and a second part. The separating module is located in the cavity and contacts the diaphragm to separate the cavity into the first and the second chambers. The first electrode set disposed in the first chamber is connected to a first sound source signal, such that the first part of the diaphragm is vibrated and the first sound source signal is exported from the first chamber. The second electrode set disposed in the second chamber is connected to a second sound source signal, such that the second part of the diaphragm is vibrated and the second sound source signal is exported from the second chamber.

14 Claims, 3 Drawing Sheets

SPEAKER

CROSS-REFERENCE TO RELATED APPLICATION

This application claims the priority benefit of U.S. provisional application Ser. No. 61/412,397, filed on Nov. 11, 2010. The entirety of the above-mentioned patent application is hereby incorporated by reference herein and made a part of this application.

BACKGROUND OF THE INVENTION

1. Field of the Invention

The invention relates to an audio device. Particularly, the invention relates to a speaker.

2. Description of Related Art

Two most direct sensory responses of mankind are visual system and hearing system. Therefore, scientists have been dedicated to develop devices or system techniques related to the visual system and the hearing system. Presently, electroacoustic speakers are mainly classified into direct and indirect radiation speakers, and according to driving methods thereof, the speakers are mainly classified into moving-coil, piezoelectric and electrostatic speakers. Whatever the speaker is, main components thereof include an electrode layer, a diaphragm and chambers.

In detail, the diaphragm includes an electret layer, and after a charging process, the electret layer may have a charge-maintaining effect in internal of the material. The electrode layer is adapted to receive sound source signals to attract or repulse charges of the electret layer, so as to drive the diaphragm to produce sounds. According to a current design, a single electrode layer is generally used to receive the sound source signals to drive the diaphragm to vibrate, and the sound output thereof is monotonous and lack of variety.

SUMMARY OF THE INVENTION

The invention is directed to a speaker, and a sound output thereof diversified.

The invention provides a speaker including a base, a diaphragm, a separating module, a first electrode set and a second electrode set. The base and a porous structure are formed a cavity. The diaphragm is disposed in the cavity and includes a first portion and a second portion. The separating module is located in the cavity and contacts the diaphragm to separate the cavity into a first chamber and a second chamber. The first chamber includes the first portion of the diaphragm, and the second chamber includes the second portion of the diaphragm. The first electrode set is disposed in the first chamber and is located at two sides of the diaphragm, and is adapted to connect a first sound source signal, such that the first portion of the diaphragm is vibrated and the first sound source signal is exported from the first chamber. The second electrode set is disposed in the second chamber and is located at two sides of the diaphragm, and is adapted to connect a second sound source signal, such that the second portion of the diaphragm is vibrated and the second sound source signal is exported from the second chamber.

In an embodiment of the invention, the diaphragm is an electret layer.

In an embodiment of the invention, the first electrode set includes a first electrode layer and a first metal thin-film electrode, and the second electrode set includes a second electrode layer and a second metal thin-film electrode.

In an embodiment of the invention, the first metal thin-film electrode is attached to the first portion of the diaphragm, and the second metal thin-film electrode is attached to the second portion of the diaphragm, where a space exists between the first metal thin-film electrode and the second metal thin-film electrode.

In an embodiment of the invention, the first metal thin-film electrode and the second metal thin-film electrode are disposed on a surface of the base, where a space exists between the first metal thin-film electrode and the second metal thin-film electrode.

In an embodiment of the invention, the first metal thin-film electrode is disposed between the base and the first portion of the diaphragm, and the second metal thin-film electrode is disposed between the base and the second portion of the diaphragm, where a space exists between the first metal thin-film electrode and the second metal thin-film electrode.

In an embodiment of the invention, the speaker further includes a plurality of supporting structures, where a part of the supporting structures supports between the first electrode set and the first portion of the diaphragm, and another part of the supporting structures supports between the second electrode set and the second portion of the diaphragm.

In an embodiment of the invention, the separating module includes a first separating structure and a second separating structure, where the first separating structure supports between the diaphragm and the base, and the second separating structure supports between the diaphragm and the porous structure.

In an embodiment of the invention, the separating module separates the first chamber and the second chamber as independent chambers, where the first portion of the diaphragm is not influenced by the second portion of the diaphragm.

In an embodiment of the invention, the first electrode layer has a plurality of first sound holes, and the second electrode layer has a plurality of second sound holes.

In an embodiment of the invention, the speaker includes two input terminals and the two input terminals are respectively connected to the first sound source signal and the second sound source signal.

In an embodiment of the invention, the speaker further includes a signal input terminal, at least a first signal line and at least a second signal line. The first signal line extends to internal of the speaker from the signal input terminal and is connected to the first electrode set, and transmits the first sound source signal to the first electrode set. The second signal line extends to the internal of the speaker from the signal input terminal and is connected to the second electrode set, and transmits the second sound source signal to the second electrode set.

In an embodiment of the invention, the first signal line and the second signal line are formed together with the first electrode set and the second electrode set.

In an embodiment of the invention, the first signal line and the second signal line are disposed on a part of the supporting structures.

According to the above descriptions, in the speaker of the invention, besides that the first electrode layer and the first metal thin-film electrode receive the first sound source signal to drive the diaphragm to vibrate, the second electrode layer and the second metal thin-film electrode further receive the second sound source signal to drive the diaphragm to vibrate. Therefore, compared to the conventional speaker that only has a single electrode layer and a single metal thin-film electrode, the speaker of the invention is more variable in sound source signal input, so as to provide the user more pleasant and high quality sound output.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
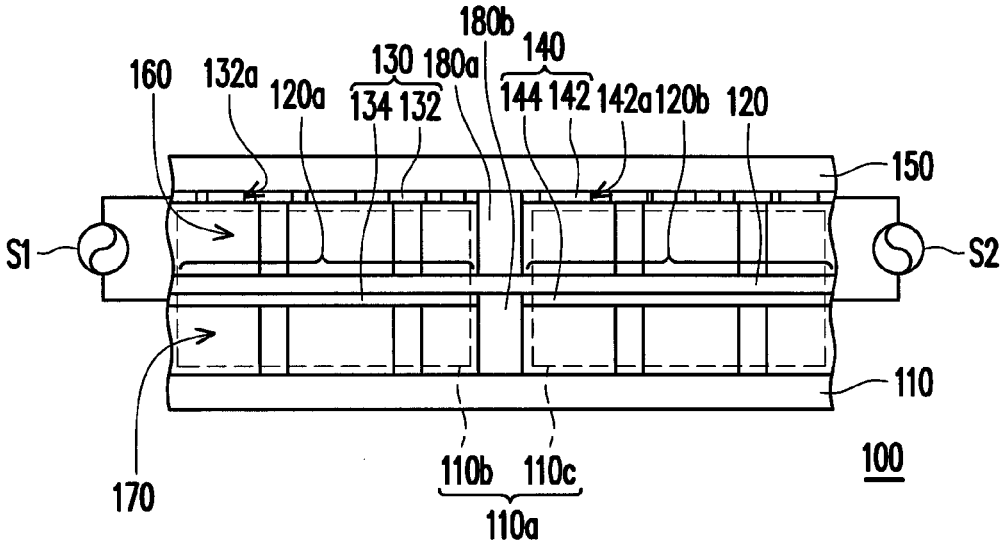
FIG. 1 is a cross-sectional view of a speaker according to an embodiment of the invention.
Figure 2:
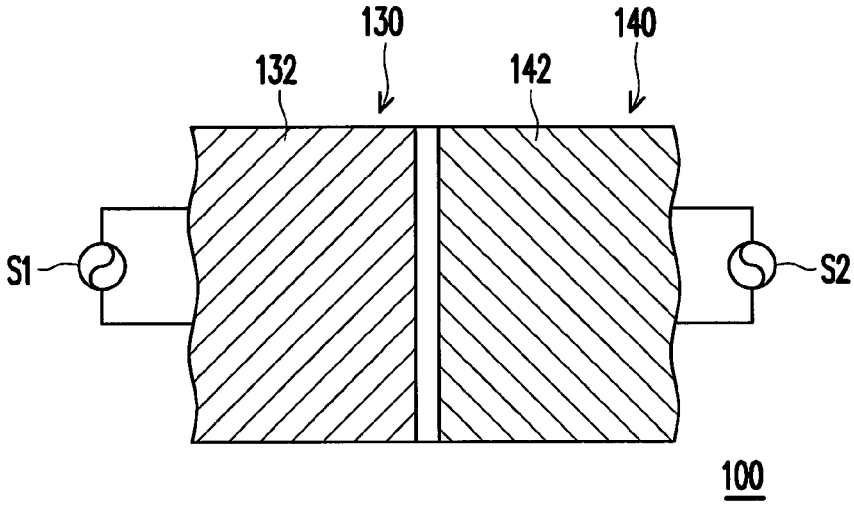
FIG. 2 is a top view of a part of components of the speaker of FIG. 1.

FIG. 1 is a cross-sectional view of a speaker according to an embodiment of the invention. FIG. 2 is a top view of a part of components of the speaker of FIG. 1. For clarity's sake, a porous structure 150 of FIG. 1 is not illustrated in FIG. 2. Referring to FIG. 1 and FIG. 2, the speaker 100 of the present embodiment includes a base 110, a diaphragm 120, a first electrode set 130 and a second electrode set 140. Along with different product designs, a shape of the speaker can be a square, a round, an oval and a triangle, etc. In the present embodiment, the shape of the speaker is, for example, a square or a rectangle, though the invention is not limited thereto.

The diaphragm 120 is disposed on the base 110. The first electrode set 130 is disposed between the base 110 and the porous structure 150 and includes a first electrode layer 132 and a first metal thin-film electrode 134, and a first portion 120*a* of the diaphragm 120 is located between the first electrode layer 132 and the first metal thin-film electrode 134. The second electrode set 140 is disposed between the base 110 and the porous structure 150 and includes a second electrode layer 142 and a second metal thin-film electrode 144, and a second portion 120*b* of the diaphragm 120 is located between the second electrode layer 142 and the second metal thin-film electrode 144. The first electrode set 130 is adapted to receive a first sound source signal S1 to drive the diaphragm 120 to vibrate, and the second electrode set 140 is adapted to receive a second sound source signal S2 to drive the diaphragm 120 to vibrate. Along with different shapes of the speaker 100, a shape of the diaphragm 120 can also be a square, a round, an oval and a triangle, etc. along with the shape of the speaker 100. In the present embodiment, the shape of the diaphragm 120 is, for example, a square, though the invention is not limited thereto. Along with different product designs, the shape of the diaphragm 120 can also be different to the shape of the speaker 100.

The first electrode layer 132, the first metal thin-film electrode 134, the second electrode layer 142 and the second metal thin-film electrode 144 are, for example, formed through a metal coating process, and a space exists between the first electrode layer 132 and the second electrode layer 142, and a space exists between the first metal thin-film electrode 134 and the second metal thin-film electrode 144. Along with different fabrication processes, the first electrode layer 132 and the second electrode layer 142 can be formed together through a photomask and metal coating process. Similarly, the first metal thin-film electrode 134 and the second metal thin-film electrode 144 can also be formed together through a photomask and metal coating process. When the first electrode layer 132 and the second electrode layer 142 are formed, the space between the first electrode layer 132 and the second electrode layer 142 can be formed together. Similarly, when the first metal thin-film electrode 134 and the second metal thin-film electrode 144 are formed, the space between the first metal thin-film electrode 134 and the second metal thin-film electrode 144 can be formed together. The first electrode layer 132, the first metal thin-film electrode 134, the second electrode layer 142 and the second metal thin-film electrode 144 can also be separately formed, which is not limited by the invention.

According to the above configuration, in the speaker 100, besides that the first electrode layer 132 and the first metal thin-film electrode 134 receive the first sound source signal S1 to drive the diaphragm 120 to vibrate, the second electrode layer 142 and the second metal thin-film electrode 144 further receive the second sound source signal S2 to drive the diaphragm 120 to vibrate. Therefore, compared to the conventional speaker that only has a single electrode layer and a single metal thin-film electrode, the speaker 100 of the present embodiment is more variable in sound source signal input, so as to provide the user more pleasant and high quality sound output.

In detail, in the present embodiment, the diaphragm 120 is, for example, an electret layer, and a material thereof can be fluorinated ethylenepropylene (FEP), polytetrafluoethylene (PTFE), polyvinylidene fluride (PVDF), fluorine polymer, or other suitable dielectric materials. The dielectric material may include micro-scale or nanometer-scale pores, so that after the diaphragm 120 is electrized, it is able to keep static charges and piezoelectricity for a long period of time to achieve a charge-maintaining effect. When the first electrode layer 132 and the first metal thin-film electrode 134 receive the first sound source signal S1, the charges of the diaphragm 120 can attract or repulse the first electrode layer 132 and the first metal thin-film electrode 134, so that the diaphragm 120 vibrates to produce sound output. Similarly, when the second electrode layer 142 and the second metal thin-film electrode 144 receive the second sound source signal S2, the charges of the diaphragm 120 can attract or repulse the second electrode layer 142 and the second metal thin-film electrode 144, so that the diaphragm 120 vibrates to produce sound output.

Referring to FIG. 2, in the present embodiment, the first electrode layer 132 has a plurality of first sound holes 132*a*, the second electrode layer 142 has a plurality of second sound holes 142*a*, and the speaker further includes the porous structure 150, which covers the first electrode layer 132 and the second electrode layer 142. In this way, when the diaphragm 120 vibrates, the sound can be output to external through the first sound holes 132*a*, the second sound holes 142*a* and the porous structure 150. Moreover, the base 110 and the porous structure 150 are formed a cavity 110*a*, and the first electrode layer 132, the second electrode layer 142, the diaphragm 120, the first metal thin-film electrode 134 and the second metal thin-film electrode 144 are all disposed in the cavity 110*a*.

The speaker 100 further includes a separating module, and the separating module includes a first separating structure 180*a* and a second separating structure 180*b*. The first separating structure 180*a* and the second separating structure 180*b* are disposed between the base 110 and the porous structure 150, where the first separating structure 180*a* is disposed between the porous structure 150 and the diaphragm 120, and the second separating structure 180*b* is disposed between the diaphragm 120 and the base 110. Along with different product designs, the first separating structure 180*a* can also be disposed between the first electrode layer 132/the second electrode layer 142 on the porous structure 150 and the diaphragm 120, which is not limited by the invention. The first separating structure 180*a* and the second separating structure 180*b* divide the cavity 110*a* into a first chamber 110*b* and a second chamber 110*c*. The first electrode layer 132, the first portion 120*a* of the diaphragm 120 and the first metal thin-film electrode 134 are located in the first chamber 110*b*, so that when the first electrode layer 132 and the first metal thin-film electrode 134 receive the first sound source signal S1 to drive the diaphragm 120 to vibrate, a resonant sound field is generated in the first chamber 110*b*. The second electrode layer 142, the second portion 120*b* of the diaphragm 120 and the second metal thin-film electrode 144 are located in the second chamber 110*c*, so that when the second electrode layer 142 and the second metal thin-film electrode 144 receive the second sound source signal S2 to drive the diaphragm 120 to vibrate, a resonant sound field is generated in the second chamber 110*c*. The separating module is mainly used to separate the first portion 120*a* and the second portion 120*b* of the diaphragm 120 and divide the cavity 110*a* formed by the base 110 and the porous structure 150 into the first chamber 110*b* and the second chamber 110*c*, so as to avoid interference between the first portion 120*a* and the second portion 120*b* of the diaphragm 120 to influence outputs of the first sound source signal S1 and the second sound source signal S2.

In the present embodiment, the first metal thin-film electrode 134 is disposed at the first portion 120*a* of the diaphragm 120, and the second metal thin-film electrode 144 is disposed at the second portion 120*a* of the diaphragm 120, where the first metal thin-film electrode 134 can be disposed at the first portion 120*a* of the diaphragm 120 through an attaching or a coating method, and the second metal thin-film electrode 144 can be disposed at the second portion 120*a* of the diaphragm 120 through the attaching or the coating method. The speaker 100 further includes a supporting module, where the supporting module includes a plurality of first supporting structures 160 and a plurality of second supporting structures 170. A position of any of the first supporting structures 160 corresponds to that of a second supporting structure 170. A part of the first supporting structures 160 supports between the first electrode layer 132 and the first portion 120*a* of the diaphragm 120, and the other part of the first supporting structures 160 supports between the second electrode layer 142 and the second portion 120*b* of the diaphragm 120. A part of the second supporting structures 170 supports between the base 110 and the first metal thin-film electrode 134, and the other part of the second supporting structures 170 supports between the base 110 and the second metal thin-film electrode 144. A suitable distance is maintained between the base 110 and the porous structure 150 due to the support of the first supporting structures 160 and the second supporting structures 170, so as to form the cavity 110*a*. The first supporting structures 160 and the first separating structure 180*a* can be formed integrally, and the second supporting structures 170 and the second separating structure 180*b* can be formed integrally, so as to facilitate fabrication and assembling of the speaker 100.

The first sound source signal S1 and the second sound source signal S2 of FIG. 1 and FIG. 2 are schematic, and an input method of the first sound source signal S1 and the second sound source signal S2 is introduced below with reference of FIG. 3. Along with different product designs, the first sound source signal S1 and the second sound source signal S2 can be respectively input through two input terminals of the speaker 100, and the first sound source signal S1 and the second sound source signal S2 are respectively exported through the first chamber 110*b* and the second chamber 110*c*. The first sound source signal S1 and the second sound source signal S2 can also enter the cavity 110*a* through a same input terminal of the speaker 100, and then the first sound source signal S1 and the second sound source signal S2 are respectively transmitted to the first chamber 110*b* and the second chamber 110*c* along a transmission circuit designed on the supporting module. The first sound source signal S1 is exported through the first chamber 110*b*, and the second sound source signal S2 is exported through the second chamber 110*c*.

Figure 3:
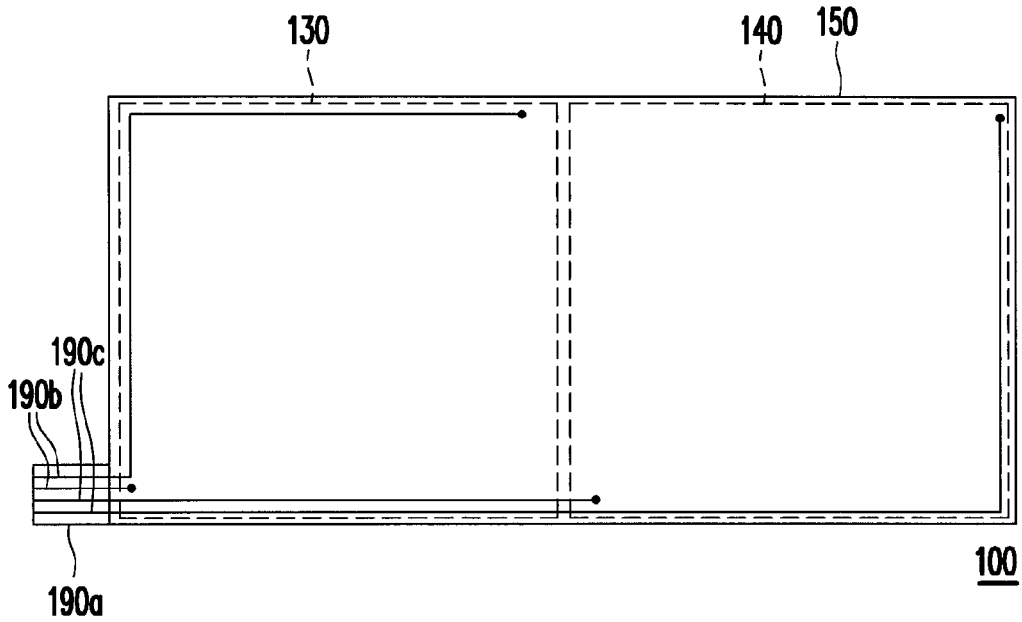
FIG. 3 is a schematic diagram of a speaker having only one input terminal.

FIG. 3 is a schematic diagram of a speaker having only one input terminal. Referring to FIG. 3, the speaker 100 of the present embodiment includes a signal input terminal 190*a*, at least one first signal line 190*b* (two first signal lines are illustrated) and at least one second signal line 190*c* (two first signal lines are illustrated). The first signal line 190*b* and the second signal line 190*c* respectively extend to the internal of the speaker 100 from the signal input terminal 190*a*, and are respectively connected to the first electrode set 130 and the second electrode set 140, so as to respectively transmit the first sound source signal S1 and the second sound source signal S2 to the first electrode set 130 and the second electrode set 140.

The first signal line 190*b* and the second signal line 190*c* can be arranged in a reserved space on the top of or under the supporting structures 160 or the supporting structures 170, so as to transmit the first sound source signal S1 and the second sound source signal S2 to preset positions to facilitate exporting the first sound source signal S1 through the first chamber 110*b* and exporting the second sound source signal S2 through the second chamber 110*c*. Moreover, while the first electrode set 130 and the second electrode set 140 are formed through the coating process, the first signal line 190*b* and the second signal line 190*c* can be formed together on the vibrating film 120 at positions corresponding to the supporting structures 160 and the supporting structures 170, so as to save a time for arranging the signal lines on the supporting structures 160 and the supporting structures 170.

In the invention, configuration positions of the first metal thin-film electrode 134 and the second metal thin-film electrode 144 are not limited, which are described below with reference of FIG. 4 and FIG. 5.

Figure 4:
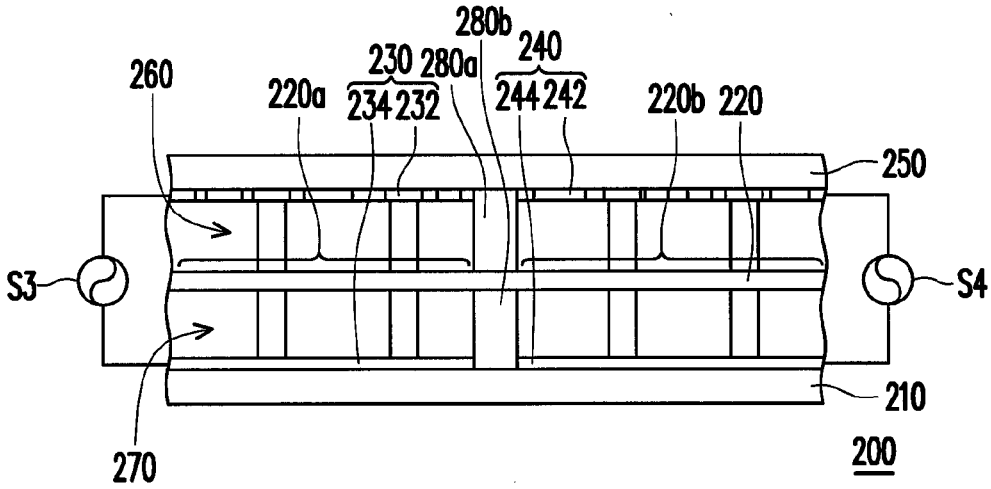
FIG. 4 is a cross-sectional view of a speaker according to another embodiment of the invention.

FIG. 4 is a cross-sectional view of a speaker according to another embodiment of the invention. Referring to FIG. 4, the speaker 200 of the present embodiment includes a base 210, a diaphragm 220, a first electrode set 230, a second electrode set 240, a porous structure 250, a plurality of first supporting structures 260, a plurality of second supporting structures 270, a first separating structure 280*a* and a second separating structure 280*b*. The first electrode set 230 includes a first electrode layer 232 and a first metal thin-film electrode 234, and the second electrode set 240 includes a second electrode layer 242 and a second metal thin-film electrode 244. The first electrode set 230 is adapted to receive a first sound source signal S3 to drive a first portion 220*a* of the diaphragm 220 to vibrate, and the second electrode set 240 is adapted to receive a second sound source signal S4 to drive a second portion 220*b* of the diaphragm 220 to vibrate.

A difference between the speaker 200 of the present embodiment and the speaker 100 of FIG. 2 is as follows. The first metal thin-film electrode 234 and the second metal thin-film electrode 244 of the present embodiment are disposed on the base 210, where the first metal thin-film electrode 234 and the second metal thin-film electrode 244 can be disposed on the surface of the base 210 through an attaching or a coating method. A part of the second supporting structures 270 supports between the first metal thin-film electrode 234 and the first portion 220*a* of the diaphragm 220, and the other part of the second supporting structures 270 supports between the second metal thin-film electrode 244 and the second portion 220*b* of the diaphragm 220. The first separating structure 280*a* and the second separating structure 280*b* are combined to form a separating module, which is used to separate the first portion 220*a* and the second portion 220*b* of the diaphragm 220, and divide a cavity 210*a* formed between the base 210 and the porous structure 250 into a first chamber and a second chamber, so as to avoid interference between the first portion 220*a* and the second portion 220*b* of the diaphragm 220 to influence outputs of the first sound source signal S3 and the second sound source signal S4.

Figure 5:
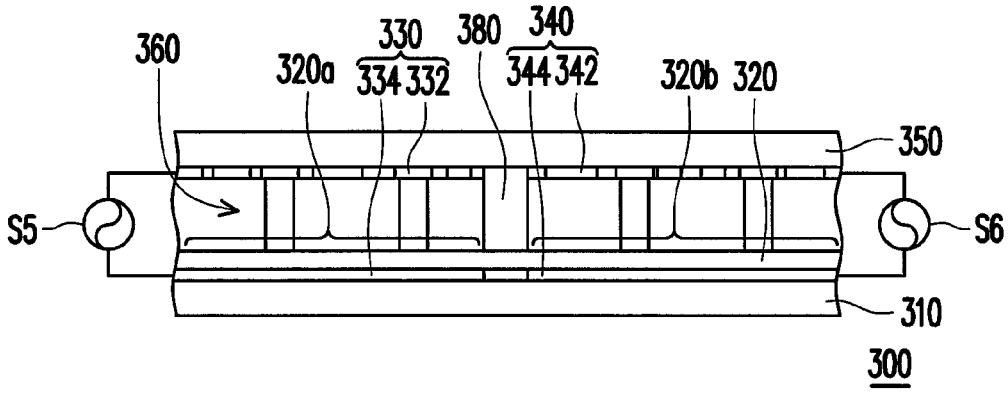
FIG. 5 is a cross-sectional view of a speaker according to another embodiment of the invention.

FIG. 5 is a cross-sectional view of a speaker according to another embodiment of the invention. Referring to FIG. 5, the speaker 300 of the present embodiment includes a base 310, a diaphragm 320, a first electrode set 330, a second electrode set 340, a porous structure 350, a supporting module 360 and a separating module 380, where the supporting module 360 includes a plurality of supporting structures. The first electrode set 330 includes a first electrode layer 332 and a first metal thin-film electrode 334, and the second electrode set 340 includes a second electrode layer 342 and a second metal thin-film electrode 344. The first electrode set 330 is adapted to receive a first sound source signal S5 to drive a first portion 320*a* of the diaphragm 320 to vibrate, and the second electrode set 340 is adapted to receive a second sound source signal S6 to drive a second portion 320*b* of the diaphragm 320 to vibrate. The separating module 380 is used to separate the first portion 320*a* and the second portion 320*b* of the diaphragm 320, and divide a cavity 310*a* formed between the base 310 and the porous structure 350 into a first chamber and a second chamber, so as to avoid interference between the first portion 320*a* and the second portion 320*b* of the diaphragm 320 to influence outputs of the first sound source signal S5 and the second sound source signal S6.

A difference between the speaker 300 of the present embodiment and the speaker 100 of FIG. 2 and the speaker 200 of FIG. 4 is as follows. The first metal thin-film electrode 334 and the second metal thin-film electrode 344 of the present embodiment are disposed between the base 310 and the diaphragm 320, so that supporting structures are not required to be configured between the first metal thin-film electrode 334 and the base 310, between the second metal thin-film electrode 344 and the base 310, between the first metal thin-film electrode 334 and the diaphragm 320 and between second metal thin-film electrode 344 and the diaphragm 320.

In summary, the separating module is used to divide cavity formed by the base and the porous structure into a plurality of chambers, so that a single chamber can output a different sound source signal. Taking two sound source signals as an example, besides that the first electrode layer and the first metal thin-film electrode receive the first sound source signal to drive the first portion of the diaphragm to vibrate, the second electrode layer and the second metal thin-film electrode further receive the second sound source signal to drive the second portion of the diaphragm to vibrate. Since the separating module separates the diaphragm into two portions, the first sound source signal output from the first chamber is not interfered with the second sound source signal output from the second chamber. Therefore, compared to the conventional speaker that only has a single electrode layer and a single metal thin-film electrode, the speaker of the invention is more variable in sound source signal input, so as to provide the user more pleasant and high quality sound output.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A speaker, comprising:

a base, wherein the base and a porous structure are formed a cavity;

a diaphragm, disposed in the cavity, and comprising a first portion and a second portion;

a separating module, located in the cavity and contacting the diaphragm to separate the cavity into a first chamber and a second chamber, wherein the first chamber comprises the first portion of the diaphragm, and the second chamber comprises the second portion of the diaphragm;

a first electrode set, disposed in the first chamber, located at two sides of the diaphragm, and adapted to connect a first sound source signal, such that the first portion of the diaphragm is vibrated and the first sound source signal is exported from the first chamber; and a second electrode set, disposed in the second chamber, located at two sides of the diaphragm, and adapted to connect a second sound source signal, such that the second portion of the diaphragm is vibrated and the second sound source signal is exported from the second chamber.

2. The speaker as claimed in claim 1, wherein the diaphragm is an electret layer.

3. The speaker as claimed in claim 1, wherein the first electrode set comprises a first electrode layer and a first metal thin-film electrode, and the second electrode set comprises a second electrode layer and a second metal thin-film electrode.

4. The speaker as claimed in claim 3, wherein the first metal thin-film electrode is attached to the first portion of the diaphragm, and the second metal thin-film electrode is attached to the second portion of the diaphragm, wherein a space exists between the first metal thin-film electrode and the second metal thin-film electrode.

5. The speaker as claimed in claim 3, wherein the first metal thin-film electrode and the second metal thin-film electrode are disposed on a surface of the base, wherein a space exists between the first metal thin-film electrode and the second metal thin-film electrode.

6. The speaker as claimed in claim 3, wherein the first metal thin-film electrode is disposed between the base and the first portion of the diaphragm, and the second metal thin-film electrode is disposed between the base and the second portion of the diaphragm, wherein a space exists between the first metal thin-film electrode and the second metal thin-film electrode.

7. The speaker as claimed in claim 1, further comprising a plurality of supporting structures, wherein a part of the supporting structures supports between the first electrode set and the first portion of the diaphragm, and another part of the supporting structures supports between the second electrode set and the second portion of the diaphragm.

8. The speaker as claimed in claim 1, wherein the separating module comprises a first separating structure and a second separating structure, wherein the first separating structure supports between the diaphragm and the base, and the second separating structure supports between the diaphragm and the porous structure.

9. The speaker as claimed in claim 1, wherein the separating module separates the first chamber and the second chamber as independent chambers, wherein the first portion of the diaphragm is not influenced by the second portion of the diaphragm.

10. The speaker as claimed in claim 3, wherein the first electrode layer has a plurality of first sound holes, and the second electrode layer has a plurality of second sound holes.

11. The speaker as claimed in claim 1, further comprising two input terminals, wherein the two input terminals are respectively connected to the first sound source signal and the second sound source signal.

12. The speaker as claimed in claim 1, further comprising:

a signal input terminal;

at least a first signal line, extending to internal of the speaker from the signal input terminal and connected to the first electrode set, and transmitting the first sound source signal to the first electrode set; and at least a second signal line, extending to the internal of the speaker from the signal input terminal and connected to the second electrode set, and transmitting the second sound source signal to the second electrode set.

13. The speaker as claimed in claim 12, wherein the first signal line and the second signal line are formed together with the first electrode set and the second electrode set.

14. The speaker as claimed in claim 7, wherein the first signal line and the second signal line are disposed on a part of the supporting structures.

* * * * *